US012110747B2

(12) United States Patent
Arsoski

(10) Patent No.: US 12,110,747 B2
(45) Date of Patent: Oct. 8, 2024

(54) CASING SHOE WITH FLOW OPERATED DIVERTER VALVE

(71) Applicant: DOWNHOLE PRODUCTS LIMITED, Aberdeen (GB)

(72) Inventor: Darko Arsoski, Angus (GB)

(73) Assignee: DOWNHOLE PRODUCTS LIMITED

( * ) Notice: Subject to any disclaimer, the term of this patent is extended or adjusted under 35 U.S.C. 154(b) by 0 days.

(21) Appl. No.: 18/366,784

(22) Filed: Aug. 8, 2023

(65) Prior Publication Data

US 2024/0068306 A1 Feb. 29, 2024

Related U.S. Application Data

(60) Provisional application No. 63/400,106, filed on Aug. 23, 2022.

(51) Int. Cl.
*E21B 17/14* (2006.01)
*E21B 34/14* (2006.01)

(52) U.S. Cl.
CPC ..... *E21B 17/14* (2013.01); *E21B 34/14* (2013.01)

(58) Field of Classification Search
CPC ..... E21B 10/18; E21B 10/60; E21B 12/06; E21B 17/14
See application file for complete search history.

(56) References Cited

U.S. PATENT DOCUMENTS

| | | | | |
|---|---|---|---|---|
| 1,873,741 | A * | 8/1932 | Crowell | E21B 17/14 166/326 |
| 2,150,311 | A * | 3/1939 | Baker | E21B 33/14 166/222 |
| 3,409,078 | A * | 11/1968 | Knox | E21B 21/10 166/374 |
| 4,825,947 | A | 5/1989 | Mikolajczyk | |
| 5,697,442 | A | 12/1997 | Baldridge | |
| 6,401,820 | B1 * | 6/2002 | Kirk | E21B 17/14 175/323 |
| 6,401,824 | B1 | 6/2002 | Musselwhite | |
| 8,657,036 | B2 | 2/2014 | Barron | |

(Continued)

FOREIGN PATENT DOCUMENTS

RU 2687834 C1 5/2019

OTHER PUBLICATIONS

American Heritage Dictionary https://www.ahdictionary.com/word/search.html?q=plenum (Year: 2024).*

*Primary Examiner* — David Carroll

(57) ABSTRACT

A shoe for use with a casing or liner string includes: a tubular body; a nose: mounted to an end of the tubular body, and having: a plenum formed therein, a front port extending longitudinally from the plenum to an exterior of the nose, and a side port extending transversely from the plenum to the exterior of the nose; and a valve repeatedly shiftable between a deployment position where the front port is open and the side port is closed and a cleaning position where the front port is closed and the side port is open. The valve shifts to the deployment position in response to forward flow through the shoe being less than a threshold flow rate. The valve shifts to the cleaning position in response to the forward flow through the shoe being greater than the threshold flow rate.

17 Claims, 3 Drawing Sheets

FIG. 2A

(56) References Cited

U.S. PATENT DOCUMENTS

| | | | | |
|---|---|---|---|---|
| 10,760,383 | B2 | 9/2020 | Mitchell | |
| 2018/0179864 | A1* | 6/2018 | Mitchell | E21B 17/14 |
| 2018/0266206 | A1* | 9/2018 | Berscheidt | E21B 34/10 |

* cited by examiner

CASING SHOE WITH FLOW OPERATED DIVERTER VALVE

BACKGROUND OF THE DISCLOSURE

Field of the Disclosure

The present disclosure generally relates to a casing shoe with a flow operated diverter valve.

Description of the Related Art

RU 2687834 discloses a shoe for the lower part of a casing string. The shoe includes a body with a central channel, one end of which is intended for connection to the casing string, a bushing inserted into the other end of the body, a central channel from below with a constriction, above which side holes are made. The bushing is inserted inside the housing with fixation by shear elements for sealing of the side holes with the possibility of movement downwards to narrowing of the central channel of the housing under action of a dropped ball and opening of side holes. On the external surface of housing there are identical screw recesses interconnected in lower part with corresponding side holes. The effect is to improve quality of cementing of the casing string due to good washing of the well bore through central flushing channel during string lowering, reliable shutting of holes in horizontal bore of shoe after completion of washing.

U.S. Pat. No. 4,825,947 discloses an apparatus either in the form of a float shoe or float collar for use in cementing a casing string within a well bore, the shoe or collar having blades extending longitudinally along the outer side thereof for centering the shoe or collar, and thus the lower end of the casing string, within the well bore.

U.S. Pat. No. 5,697,442 discloses an apparatus in the form of a float shoe or collar for use in cementing a casing string within a well bore. The shoe or collar has blades extending therefrom for centering the shoe or collar, as well as the lower end of the casing string, within the well bore. The blades include jetting ports positioned therein for use in jetting the formation. In an alternative embodiment, the jetting ports are located between blades which are generally convoluted and extend circumferentially part-way around the perimeter of the apparatus.

U.S. Pat. No. 6,401,820 discloses a tubing shoe including: a body for mounting on the end of a tubing string; and reaming members extending longitudinally and helically around the body, the reaming members providing substantially complete circumferential coverage of the body whereby, in use, when the tubing shoe is advanced axially into a bore, the reaming members provide reaming around the shoe circumference. A rotatable torque reducing sleeve or centralizer may also be mounted on the body, rearwardly of the reaming members.

U.S. Pat. No. 6,401,824 discloses an improved float shoe/collar apparatus for use during casing run in or floated in. The apparatus has an inner tubular member and outer tubular member, movable upon release of shear pins to cause longitudinal movement relative to each other. The movement of the inner tubular member closes a plurality of downward jets and opens a plurality of upward jets. The apparatus also is equipped with a set of check valves, held open on run in, and activated to close upon cementing to prevent "u-tubing" of fluid back into the casing.

U.S. Pat. No. 8,657,036 discloses a tubing shoe with a body adapted to be connected to a section of tubing to be emplaced in a wellbore and a nose provided on the body, wherein the nose includes a failure guide structure for controlling break-up of the nose upon being drilled out from inside the nose. The failure guide structure typically controls break up by limiting the maximum size of pieces of the nose broken off upon drill out, for example, by defining weakened areas of the nose which are prone to failure upon drilling. The failure guide structure can include discontinuities such as slots or bores formed or drilled into the outer surface of the nose. The failure guide structure controls the breakup of the nose in a consistent and predictable manner, and typically at a predictable stage during the drill-out process.

U.S. Pat. No. 10,760,383 discloses a casing shoe having a composite body portion, a coupling portion attached to one end of the body portion, and a one-way check valve assembly positioned in the body portion, the valve assembly and body portion having a centerline nozzle and a plurality of circumferentially spaced smaller diameter nozzles positioned around the centerline nozzle.

SUMMARY OF THE DISCLOSURE

The present disclosure generally relates to a casing shoe with a flow operated diverter valve. In one embodiment, a shoe for use with a casing or liner string includes: a tubular body; a nose: mounted to an end of the tubular body, and having: a plenum formed therein, a front port extending longitudinally from the plenum to an exterior of the nose, and a side port extending transversely from the plenum to the exterior of the nose; and a valve repeatedly shiftable between a deployment position where the front port is open and the side port is closed and a cleaning position where the front port is closed and the side port is open. The valve shifts to the deployment position in response to forward flow through the shoe being less than a threshold flow rate. The valve shifts to the cleaning position in response to the forward flow through the shoe being greater than the threshold flow rate.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
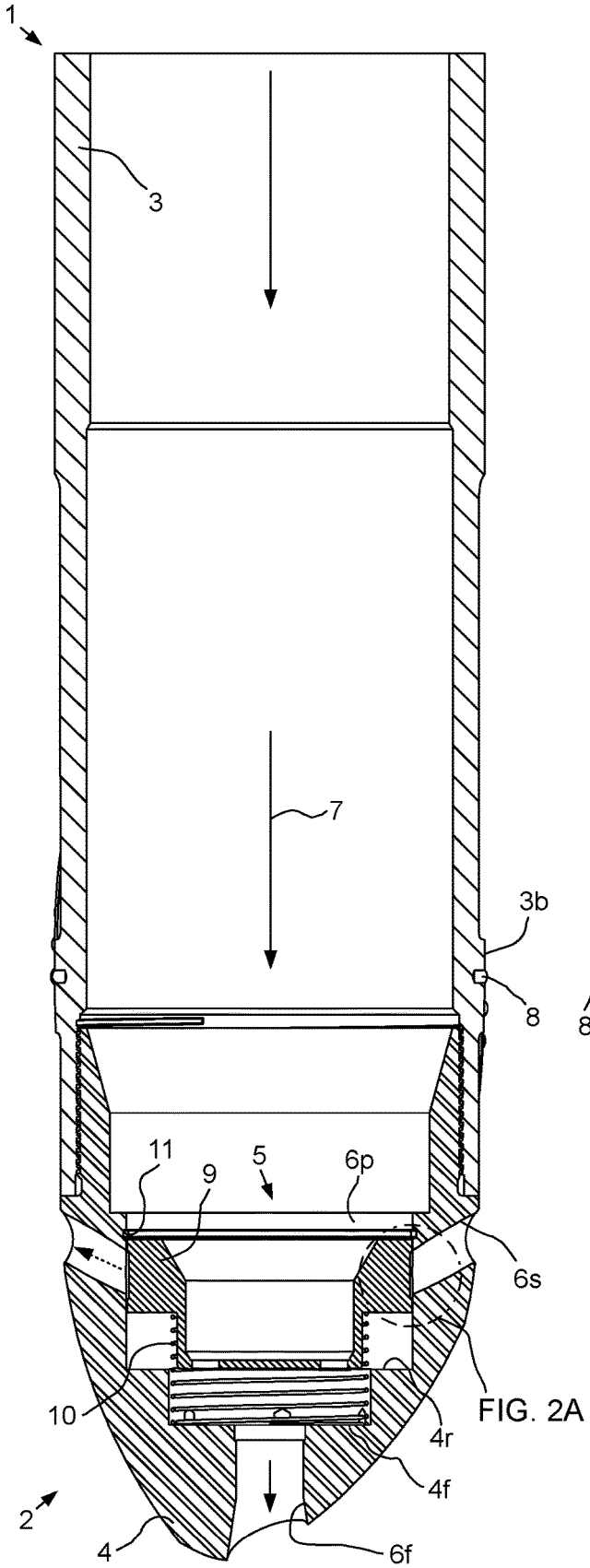
FIG. 1A illustrates a casing shoe with a flow operated diverter valve in a deployment position, according to one embodiment of the present disclosure.
Figure 1B:
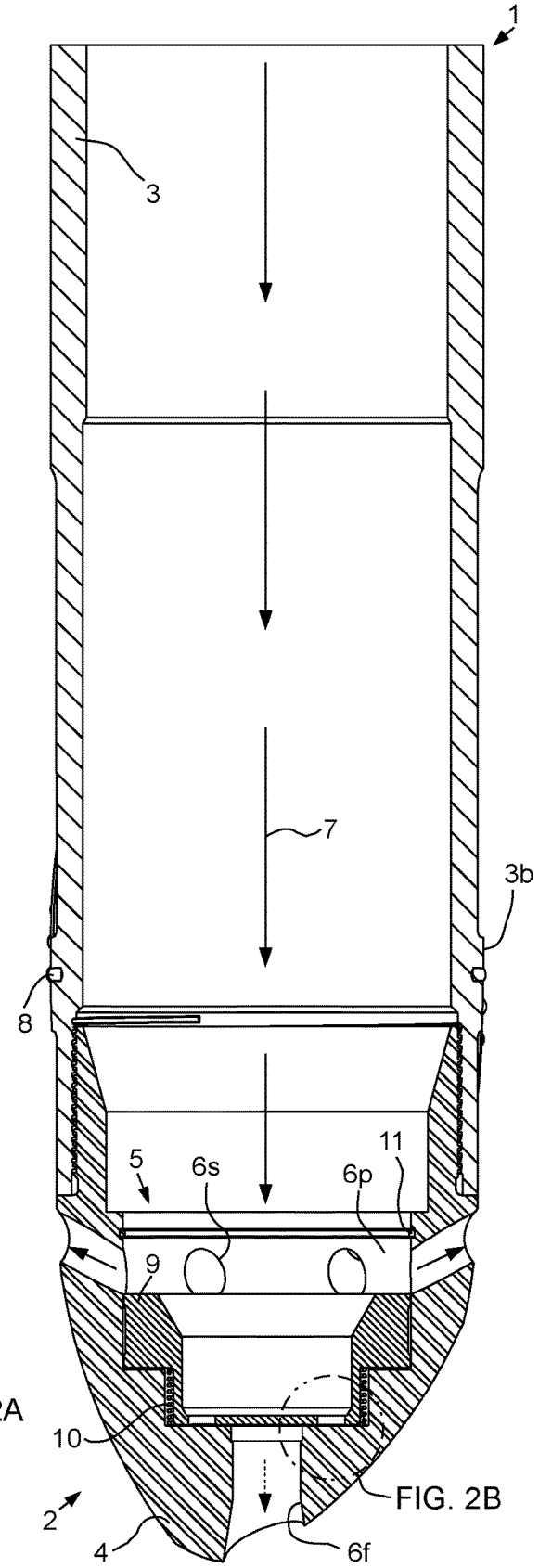
FIG. 1B illustrates the casing shoe with the flow operated diverter valve in a cleaning position.
Figure 2A:
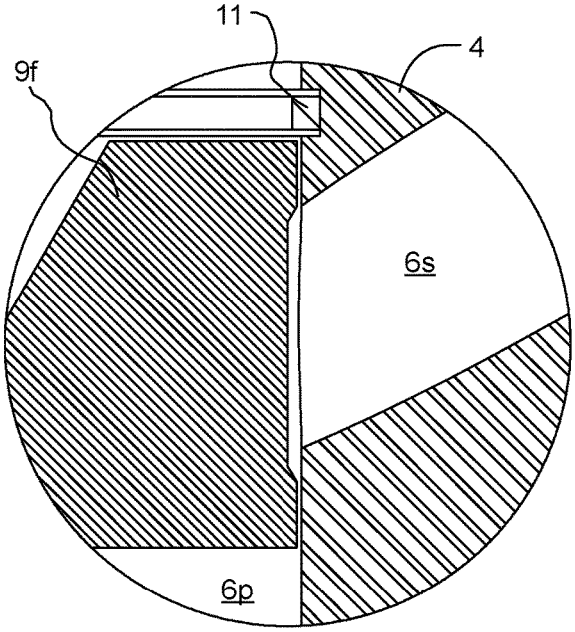
FIG. 2A is an enlargement of a portion of FIG. 1A.
Figure 2B:
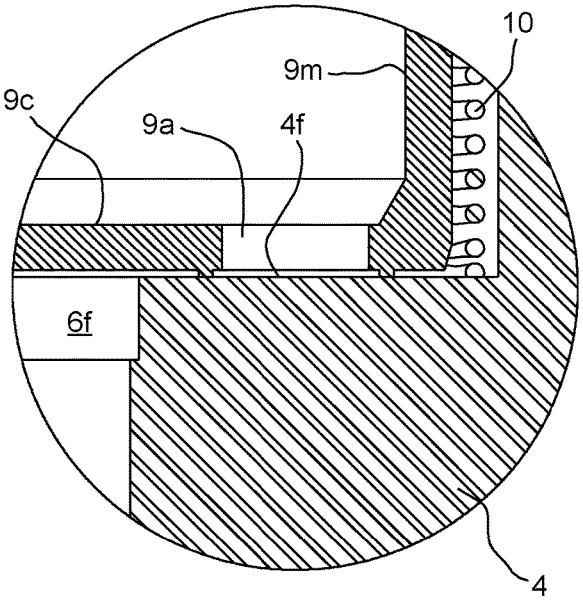
FIG. 2B is an enlargement of a portion of FIG. 1B.

FIG. 1A illustrates a casing shoe 1 with a flow operated diverter valve 5 in a deployment position, according to one embodiment of the present disclosure. FIG. 1B illustrates the casing shoe with the valve 5 in a cleaning position. FIG. 2A is an enlargement of a portion of FIG. 1A. FIG. 2B is an enlargement of a portion of FIG. 1B. The casing shoe 1 may include a nose assembly 2 and a body 3. The nose assembly 2 may include a nose 4 and the valve 5. The casing shoe 1 may be a reamer shoe.

Alternatively, the casing shoe 1 may be a guide shoe, a rasping shoe, or a float shoe.

The nose 4 may include a rearward shank portion and a forward base portion. The base portion may have an eccentric conical shape. The eccentricity in the conical shape may be formed by truncating a concentric conical shape with an inclined plane (with an inclination ranging between thirty and sixty degrees to a longitudinal axis of the nose) and omitting the smaller intersected portion. The nose 4 may be made from a metal or alloy. The metal or alloy may be drillable by a polycrystalline diamond compact (PDC) drill bit, such as being nonferrous, such as an aluminum alloy, such as aluminum-bronze. By nonferrous, it is meant that the material contains no more than a trace amount of iron. To facilitate drill out by a subsequent drill bit (not shown), the base portion may have one or more blind fragmentation apertures (not shown) formed in an outer surface thereof and extending therein.

Alternatively, the base portion of the nose 4 may have a concentric conical shape, a similarly truncated eccentric ogive shape, or a concentric ogive shape.

The shank portion of the nose 4 may have a flow bore formed therethrough and the base portion thereof may have a plenum 6*p* formed therein in fluid communication with the flow bore of the shank. The base portion of the nose 4 may have a front port 6*f* longitudinally extending from the plenum 6*p* to an exterior of the nose 4 and one or more of side ports 6*s* transversely extending from the plenum to the exterior of the nose. Each side port 6*s* may be aimed rearward and outward to discharge fluid 7 pumped down through the bore of a casing or liner string to wash cuttings formed by the casing shoe 1 upward along an annulus formed between the casing or liner string and the wellbore. An outer surface of the shank portion of the nose 4 may have a coupling, such as a threaded coupling, formed in an outer surface thereof for connection to the body 3.

The plenum 6*p* may have a reduced diameter forward portion and an enlarged diameter rearward portion defined by an inner surface of the base portion of the nose 4. The inner surface of the base portion of the nose 4 may form a rearward shoulder 4*r* at the junction between the forward and rear portions of the plenum 6. The front port 6*f* may extend from the forward portion of the plenum 6*p* and the side ports 6*s* may extend from the rearward portion of the plenum. The inner surface of the base portion of the nose 4 may form a forward shoulder 4*f* at the junction between the forward portion of the plenum 6 and the front port 6*f*.

The body 3 may be tubular and have a flow bore formed therethrough. The body 3 may be formed of a metal or alloy, such as steel. The body 3 may further have a plurality of blades 3*b* protruding from an outer surface thereof and extending there-along at an inclined angle or in a helical fashion relative to a longitudinal axis thereof. The body blades 3*b* may have a left-handed orientation. The body blades 3*b* may be sized and arranged to cumulatively provide complete circumferential coverage around the body 3. The body 3 may have a coupling, such as a threaded coupling, formed at an inner surface of a forward end thereof for receiving the shank thread of the nose 4, thereby connecting the two members. A plurality of buttons 8 may be mounted into sockets formed along the body blades 3*b*, such as by brazing or interference fit. Each button 8 may be an insert and may be made from a hard material, such a ceramic or cermet, such as tungsten carbide or cobalt-tungsten carbide. The body 3 may have a threaded coupling formed at a rearward end thereof for assembly of the casing shoe 1 as part of the casing or liner string. Each button 8 may have a cylindrical mounting portion and a hemispherical or quasi hemispherical shaped working portion.

Figure 2C:
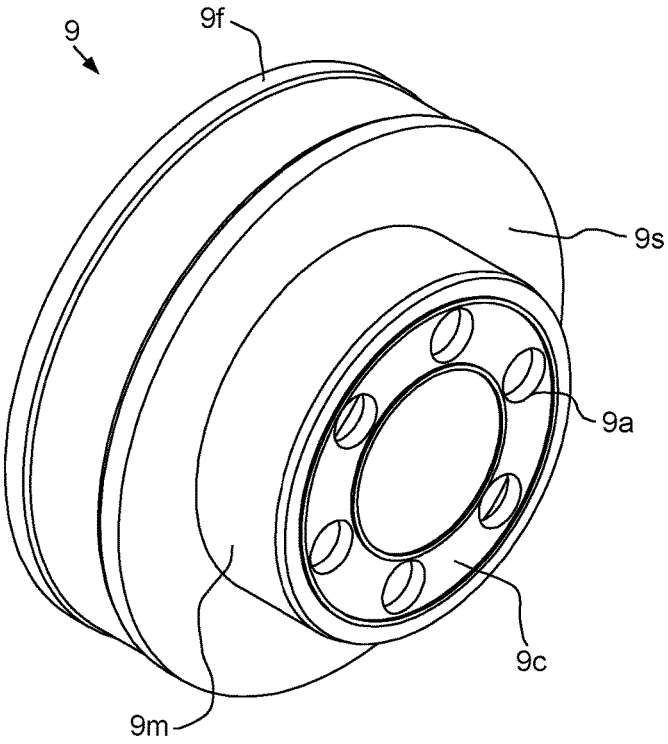
FIG. 2C illustrates a piston of the flow operated diverter valve.

FIG. 2C illustrates a piston 9 of the valve 5. Referring also to FIGS. 1A-2B, the valve 5 may include the piston 9, a biasing member, such as spring 10, and a retainer, such as split ring 11. The components 9-11 of the valve 5 may each be made from the PDC drillable nonferrous metal or alloy, such as beryllium copper. The piston 9 may be disposed in the plenum 6*p* and kept therein by the split ring 11. The split ring 11 may be snapped into a groove formed in the inner surface of the base portion of the nose 4 at a location rearward of the side ports 6*s*. The piston 9 may have having a rearward flange portion 9*f*, a forward cap portion 9*c*, a stem portion 9*m* connecting the flange and cap portions, and a shoulder 9*s* formed at the junction of the flange and stem portions. The flange and stem portions 9*f,m* may each be annular and the cap portion 9*c* may be disk-shaped. The flange portion 9*f* may have an enlarged outer diameter relative to the outer diameter of the stem and cap portions 9*m,c*.

Alternatively, the piston 9 may be made from a dissolvable metal or alloy which dissolves in a controlled manner in the presence of wellbore fluid (aqueous chloride), such as a magnesium alloy.

The outer diameter of the flange portion 9*f* may correspond to an inner diameter to the rearward portion of the plenum 6*p* with a clearance formed therebetween, thereby resulting in an engineering fit, such as a sliding fit, between the flange portion and the nose 4. The flange portion 9*f* may have a groove formed in an outer surface thereof and the groove may have a length corresponding to a diameter of the side ports 6*s*. The flange portion 9*f* may have a tapered bore formed in a rearward portion thereof and a constant diameter bore formed in a forward portion thereof. The tapered bore of the flange portion 9*f* may flare inwardly toward the stem portion 9*m*. The stem portion 9*m* may have a constant diameter bore formed therethrough. The cap portion 9*c* may have a tapered bore formed in a rearward portion thereof and a one or more apertures 9*a* formed adjacent a periphery thereof at a forward portion thereof. The tapered bore of the cap portion 9*c* may flare inwardly toward the apertures 9*a* thereof. Collectively, the bores of the flange, stem, and cap portions 9*f,s,c* and the apertures 9*a* of the cap portion may define a flow path through the piston 9. The cap portion 9*c* may have annular inner and outer rims protruding from a forward face thereof for engagement with the forward nose shoulder 4*f*. The inner and outer rims may straddle the apertures 9*a*.

Alternatively, each rim may be perforated to provide bypass channels for debris clearing.

The spring 10 may be a compression spring. The spring 10 may be longitudinally disposed between the piston shoulder 9*s* and the forward shoulder 4*f* of the nose 4, thereby biasing the piston into engagement with the split ring 11. The spring 10 may be radially disposed between an outer surface of the stem and cap portions 9*m,c* and an inner surface of the nose 4 adjacent to the forward portion of the plenum 6*p*. When the piston 9 is in the deployment position, the spring 10 may be preloaded to maintain engagement of the piston with the snap ring while withstanding a significant hydrodynamic drag force by the fluid 7 being pumped through the piston such that the piston will stay in the deployment position until the fluid is pumped through the casing shoe 1 at a threshold flow rate. The threshold flow rate may be significantly greater than zero, such as greater than or equal to twenty-five, fifty, or one hundred gallons per minute.

The piston 9 may be longitudinally movable relative to the nose 4 between the deployment position and the cleaning position. While in the deployment position, the flange portion 9*f* may completely cover an inlet of the side ports 6*s*, thereby closing the side ports. Also, while in the deployment position, the apertures 9*a* of the cap portion 9*c* may be clear of the forward nose shoulder 4*f*, thereby being open to longitudinal flow of the fluid through the piston 9 and into the front port 6*f*. Due to the seal-less interface between the flange portion 9*f* and the nose 4, some of the fluid 7 may leak into the side ports 6*s* (leakage depicted by dashed arrow). While greater than zero, the leakage may only be a small percentage of the fluid flow through the front port 6*f*, such as between one and ten percent or between one and five percent of the fluid flow through the front port.

To shift the valve 5 to the cleaning position, pumping of the fluid 7 may be increased to a flow rate greater than the threshold flow rate (increase depicted by more arrows), thereby increasing the hydrodynamic drag force exerted on the piston 9 by the fluid flow therethrough and overcoming the preload of the spring 10 to move the piston forward until a front face of the cap portion 9*c* engages the forward nose shoulder 4*f*. In the cleaning position, a solid portion of the cap front face may completely cover an inlet of the front port 6*f*, thereby closing the front port. Also while in the deployment position, the flange portion 9*f* may be clear of the side ports 6*s*, thereby being open to transverse flow of the fluid from the bore of the shank portion of the nose, into the side ports 6*s* via an open portion of the rearward portion of the plenum 6*p*. Due to the seal-less interface between the cap portion 9*c* and the nose 4, some of the fluid 7 may leak into the front port 6*f* (leakage depicted by dashed arrow). While greater than zero, the leakage may only be a small percentage of the fluid flow through the side ports 6*s*, such as between one and ten percent or between one and five percent of the fluid flow through the side ports.

In operation, the casing shoe 1 is assembled as part of the casing or liner string. The casing or liner string, with the casing shoe 1 at the front end thereof, is deployed into a crude oil and/or natural gas, geothermal, or water wellbore to a desired depth. As the casing or liner sting is being deployed, the fluid 7 may be pumped therethrough and the casing or liner string rotated. The fluid 7 may be a liquid, such as conditioner. The fluid 7 may be pumped at a rate less than the threshold rate so that the valve 5 is in the deployment position. The casing shoe 1 may guide the casing or liner string into the wellbore and may cut through any obstructions encountered in the wellbore. Should lowering of the casing or liner string be slowed by an onerous obstruction, after and/or during clearing the obstruction with the casing shoe 1, the flow rate of the fluid 7 may be increased to shift the valve 5 to the cleaning position, thereby facilitating clearing of the obstruction and washing the cuttings from the obstruction along the annulus formed between the casing or liner string and the wellbore and to a rig located at surface. Once the obstruction has been cleared, the flow rate of the fluid 7 may be reduced to a rate less than the threshold rate, thereby returning the valve 5 to the deployment position. Once the desired depth has been reached, the valve 5 may again be shifted to the cleaning position for cleaning the wellbore in preparation for cementing. The casing or liner string may then be secured in place by pumping cement slurry into the annulus formed between the casing or liner string and the wellbore. The nose 4 (except for the shank portion) may then be drilled through by a PDC drill bit of a subsequent drill string deployed into the wellbore for extending the depth of the wellbore.

Advantageously, the valve 5 provides the ability to control and direct fluid 7 discharging from the nose 4 by varying flow rate of the fluid pumped through the casing or liner string. In the cleaning mode, the valve 5 increases fluid velocity through the side ports 6*s* due to closing of the front port 6*f*, thereby increasing the capability for debris clearing and cleaning of the wall of the wellbore. In the deployment mode, the valve 5 increases fluid velocity through the front port 6*f* and reduces erosion of the side ports 6*s* by closing the side ports, thereby increasing the capability for clearing obstructions in the wellbore.

Alternatively, the nose 4 may be lengthened in order to add an intermediate position to the valve 5. In the intermediate position, the piston 9 would be clear of both the side ports 6*s* and the front port 9*f*, thereby having all of the ports open concurrently. The alternative valve would then have two threshold flow rates including a first lesser threshold flow rate and a second greater threshold flow rate. The alternative valve would be in the deployment position when the flow rate is less than both threshold flow rates. The alternative valve would be in the intermediate position when the flow rate is greater than the first threshold flow rate and less than the second threshold flow rate. The alternative valve would be in the cleaning position when the flow rate is greater than both threshold flow rates.

Alternatively, the plenum 6*p* may be lengthened rearward into the shank portion of the nose 4, the nose lengthened, the piston 9 lengthened, the piston modified to add side ports, and the split ring 11 moved rearward to add a neutral position to the valve 5. In the neutral position, the piston side ports would be aligned with the nose side ports 6*s* and clear of the front port 9*f*, thereby having all of the ports open concurrently. The alternative valve would then have two threshold flow rates including a first lesser threshold flow rate and a second greater threshold flow rate. The alternative valve would be in the neutral position when the flow rate is less than both threshold flow rates. The alternative valve would be in the deployment position when the flow rate is greater than the first threshold flow rate and less than the second threshold flow rate. The alternative valve would be in the cleaning position when the flow rate is greater than both threshold flow rates.

Alternatively, although the valve 5 is responsive to forward flow through the casing or liner string (pumping down the bore of the casing or liner string and up the annulus to surface), the valve 5 may remain in the deployment position during reverse flow into or through the casing or liner string, such as if the casing or liner string were lowered into the wellbore and allowed to become filled with wellbore fluid. The casing or liner string may be equipped with an auto-fill float valve and the valve 5 would not obstruct such an operation. To further facilitate such an operation, the nose 4 may have additional or enlarged front port(s).

Alternatively, the casing shoe 1 may be drilled through by a PDC casing bit of a subsequent casing or liner string or a roller cone or hybrid drill bit of a subsequent drill string.

Figure 2D:
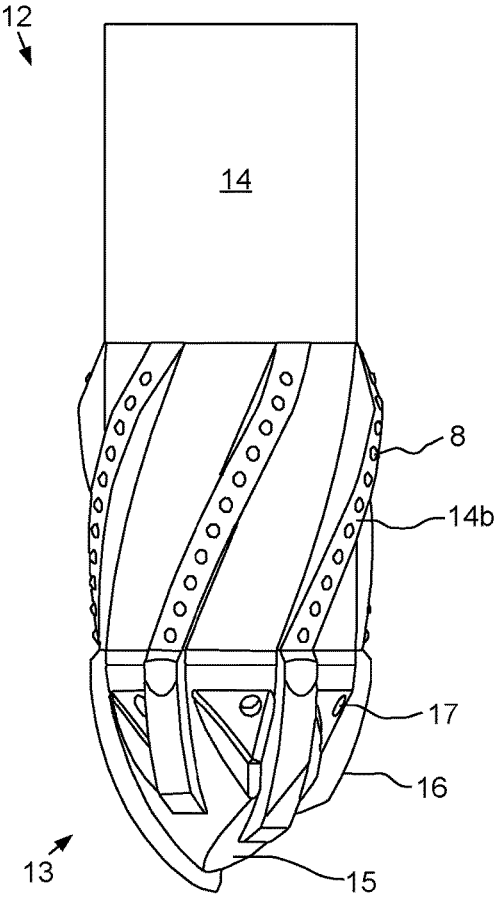
FIG. 2D illustrates an alternative casing shoe with the flow operated diverter valve, according to another embodiment of the present disclosure.

FIG. 2D illustrates an alternative casing shoe 12 with the flow operated diverter valve 5 (not shown), according to another embodiment of the present disclosure. The casing shoe 1 may also be a reamer shoe and include a nose assembly 13 and a body 14. The body 14 may be similar or identical to the body 3 except that the blades 14*b* thereof may have a right-handed orientation instead of the left-handed orientation of the body blades 3*b*. The nose assembly 13 may include a nose 15 and the valve 5. The nose 15 may include a rearward shank portion (not shown), a forward base portion, and a plurality of blades 16 spaced around the base portion at regular intervals. The base portion and nose blades 16 may be integrally formed, such as by casting. The base portion may have any of the shapes discussed above for the base portion of the nose 4. The nose 15 may be made from any of the materials discussed above for the nose 4.

Each nose blade 16 may be arcuate and may protrude from an outer surface of the base portion and extend from an (visible) interface between the nose 15 and the body 14 along the outer surface of the base portion. One or more of the nose blades 16 may extend to a tip of the base portion (aka primary blades) and one or more of the blades may terminate before reaching the tip of the base portion (aka secondary blades). The base portion may have a plurality of junk slots formed in an outer surface thereof. Each junk slot may be formed adjacent to one of the side surfaces of a respective nose blade 16. The junk slots may each extend from the interface between the nose 15 and the body 14 toward the tip of the base portion to an extent about equal to the shortest secondary nose blade 16. The junk slots may each converge as they extend toward the tip of the base portion.

The interior or the nose 15 may be similar or identical to the interior of the nose 4 except that the side ports 17 thereof may be formed at each junk slot and may be aimed forward and outward to instead of rearward and outward like the side ports 6*s*. To facilitate drill out by a subsequent drill bit (not shown), the base portion may have one or more blind fragmentation apertures formed in an outer surface thereof and extending therein. The fragmentation apertures may be arranged in rows and each row may be located between one of the blades 16 and the junk slot of the next blade.

Figure 3A:
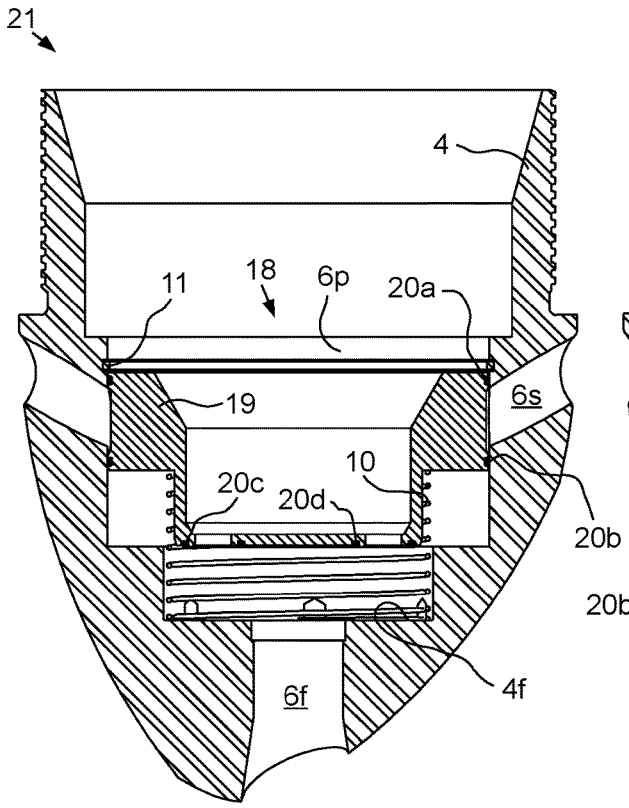
FIGS. 3A-3C illustrate an alternative flow operated diverter valve, according to another embodiment of the present disclosure.
Figure 3B:
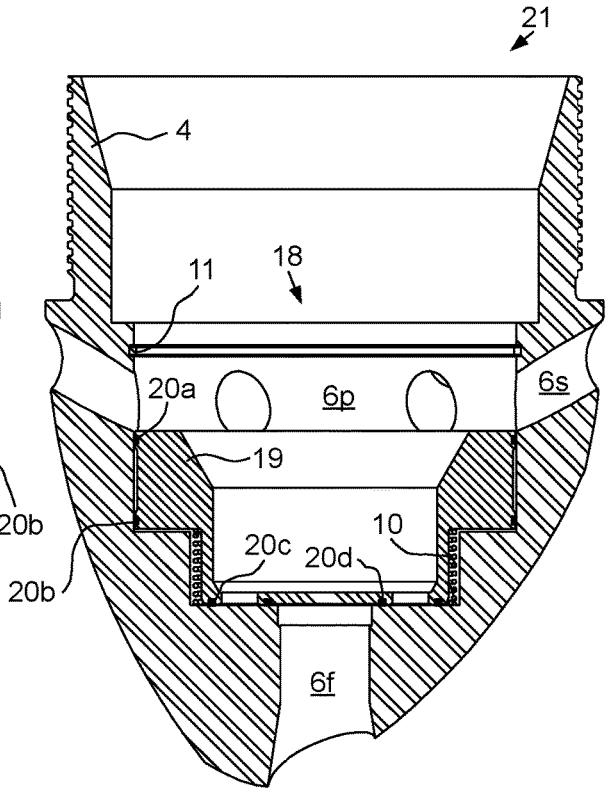
Figure 3C:
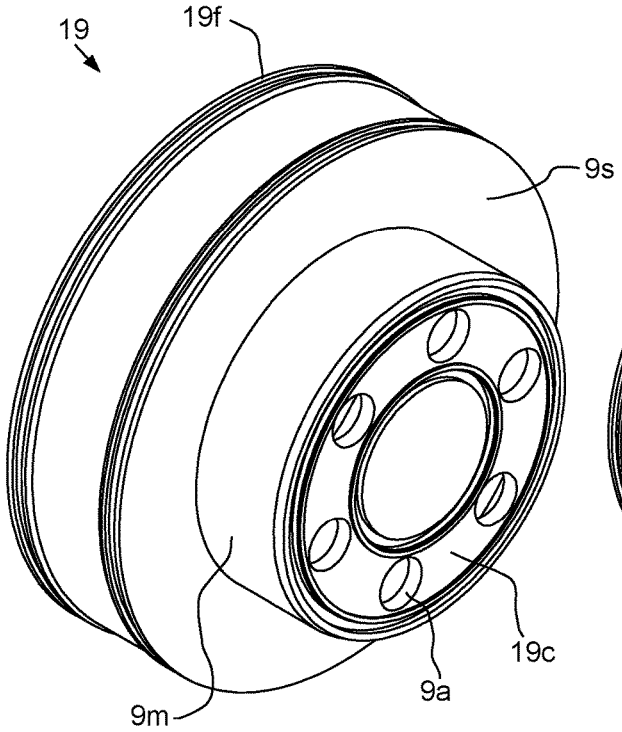

FIGS. 3A-3C illustrate an alternative flow operated diverter valve 18, according to another embodiment of the present disclosure. The alternative valve 18 may be assembled with the nose 4 to form an alternative nose assembly 21, which may be assembled with the body 3 to form an alternative casing shoe. The alternative valve 18 may include a piston 19, the spring 10, the split ring 11, a pair of side seals 20*a,b*, and a pair of aperture seals 20*c,d*. The piston 19 may be similar or identical to the piston 9 except for the addition of a pair of side glands and the addition of a pair of aperture glands. Each side gland may be formed in an outer surface of a flange portion 19*f* of the piston 19 adjacent to the groove thereof, thereby straddling the groove. Each aperture gland may be formed in the front face of a cap portion 19*c* thereof adjacent to a respective one of the inner and outer rims, thereby straddling the apertures 9*a*. Each seal 20*a-d* may be annular and may be made from an elastomeric material, such as an elastomer or elastomeric copolymer, and may be disposed in a respective gland. Each seal 20*a-d* may protrude from the respective gland. The side seals 20*a,b* may protrude into engagement with the an inner surface of the nose 4 adjacent to the rearward portion of the plenum 6*p*, thereby sealing an interface between the flange portion 19*f* and the nose when the piston 19 is in the deployment position and eliminating the leakage through the side ports 6*s*. The aperture seals 20*c,d* may protrude into engagement with the forward nose shoulder 4*f*, thereby sealing an interface between the cap portion 19*c* and the nose 4 when the piston 19 is in the cleaning position and eliminating the leakage through the front port 6*f*.

Advantageously, the alternative flow operated diverter valve 18 may be shifted into and kept in the cleaning position (FIG. 3B) as the casing or liner string is being deployed into the wellbore to prevent entry of debris through the front port 6*f* or at least when the casing or liner string is being deployed into debris-laden portions of the wellbore, such as the open-hole section.

Figure 3D:
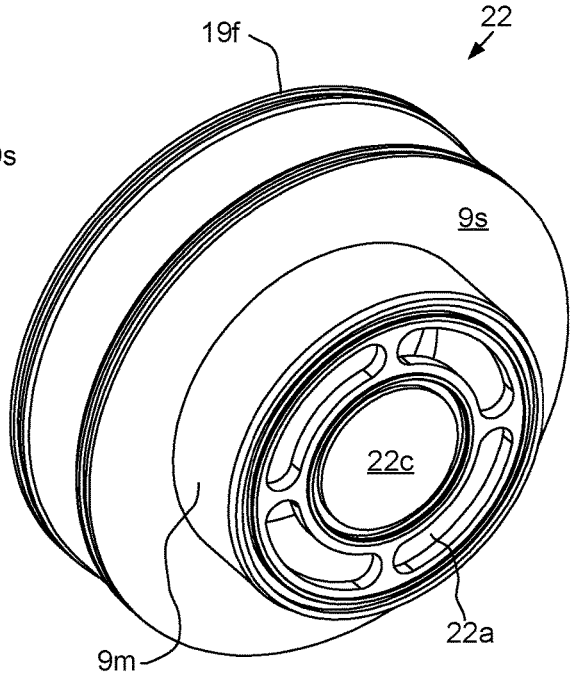
FIG. 3D illustrates an alternative piston usable with the flow operated diverter valve, according to another embodiment of the present disclosure.

FIG. 3D illustrates an alternative piston 22 usable with the alternative flow operated diverter valve 18, according to another embodiment of the present disclosure. The alternative piston 22 may be similar or identical to the piston 19 except for having alternative apertures 22*a* formed through the cap portion 22*c* thereof instead of the apertures 9*a*. The apertures 22*a* may be accurate slots as compared to the apertures 9*a* which may be holes. The apertures 22*a* may increase flow through area of the cap portion 22*c* as compared to the apertures 9*a*.

While the foregoing is directed to embodiments of the present disclosure, other and further embodiments of the disclosure may be devised without departing from the basic scope thereof, and the scope of the invention is determined by the claims that follow.

The invention claimed is:

1. A shoe for use with a casing or liner string, comprising:

a tubular body;

a nose: mounted to an end of the tubular body, and having: a chamber formed therein, a front port extending longitudinally from the chamber to an exterior of the nose, and a side port extending transversely from the chamber to the exterior of the nose; and a valve repeatedly shiftable between a deployment position where the front port is open and the side port is closed and a cleaning position where the front port is closed and the side port is open and comprising a piston disposed in the chamber and movable between the positions, wherein:

the valve is configured to shift to the deployment position in response to forward flow through the shoe being less than a threshold flow rate, the valve is configured to shift to the cleaning position in response to the forward flow through the shoe being greater than the threshold flow rate, the piston has a cap portion formed at an end thereof, the cap portion has an aperture formed therein adjacent to a periphery thereof, the piston covers an inlet of the side port in the deployment position, and a solid portion of the cap portion covers an inlet of the front port in the cleaning position.

2. The shoe of claim 1, wherein the valve further comprises:

a retainer connected to the nose; and a spring biasing the piston toward engagement with the retainer.

3. The shoe of claim 2, wherein:

the piston further has:

a flange portion having a diameter and having a fit with an inner surface of the nose adjacent to the chamber;

a stem portion having a diameter reduced relative to the flange diameter; and a shoulder formed at the junction of the flange portion and the stem portion, and the cap portion is formed at an end of the stem portion distal from the shoulder.

4. The shoe of claim 3, wherein:

an interface between the flange portion and the nose is seal-less, and an interface between the cap portion and the nose is seal-less.

5. The shoe of claim 3, wherein:

the flange portion carries a pair of seals for sealing an interface between the flange portion and the nose, and the cap portion carries a pair of seals for sealing and interface between the cap portion and the nose.

6. The shoe of claim 3, wherein:

the cap portion has annular inner and outer rims protruding from a face thereof for engagement with the nose in the cleaning position, and the inner and outer rims straddle the aperture.

7. The shoe of claim 3, wherein the aperture is a hole.

8. The shoe of claim 3, wherein the aperture is an arcuate slot.

9. The shoe of claim 3, wherein the spring is disposed between the shoulder and the nose.

10. The shoe of claim 1, wherein the body has a blade protruding from an outer surface thereof.

11. The shoe of claim 10, wherein the nose has a blade protruding from an outer surface thereof.

12. The shoe of claim 1, wherein:

the body has a threaded coupling formed at a rearward end thereof for assembly as part of a casing or liner string; and the nose is mounted to the body by threaded couplings.

13. The shoe of claim 1, wherein the nose and the valve are each made from PDC drillable materials.

14. The shoe of claim 1, wherein:

the piston further has a flange portion fit with an inner surface of the nose adjacent to the chamber, an interface between the flange portion and the nose is seal-less, and an interface between the cap portion and the nose is seal-less.

15. The shoe of claim 1, wherein:

the piston further has a flange portion fit with an inner surface of the nose adjacent to the chamber, the flange portion carries a pair of seals for sealing an interface between the flange portion and the nose, and the cap portion carries a pair of seals for sealing and interface between the cap portion and the nose.

16. The shoe of claim 1, wherein:

the cap portion has annular inner and outer rims protruding from a face thereof for engagement with the nose in the cleaning position, and the inner and outer rims straddle the aperture.

17. The shoe of claim 1, wherein the aperture is an arcuate slot.

* * * * *